US005356135A

United States Patent [19]

Montgomery

[11] Patent Number: 5,356,135

[45] Date of Patent: Oct. 18, 1994

[54] COMBINATION HOCKEY AND ROLLER BALL REFLEX PRACTISE BOARD

[76] Inventor: Robert D. Montgomery, 1685 W. 12th St., Reno, Nev. 89503

[21] Appl. No.: 96,438

[22] Filed: Jul. 26, 1993

[51] Int. Cl.[5] ..... A63B 69/00

[52] U.S. Cl. ..... 273/57.2; 273/126 A; 273/85 R; 273/128 R

[58] Field of Search ..... 273/57.2, 126, 85 R, 273/85 A, 85 B, 85 C, 85 D, 85 F, 9, 382, 381, 29 A, 30, 128 R

[56] References Cited

U.S. PATENT DOCUMENTS

| | | | |
|---|---|---|---|
| 602,180 | 4/1898 | Haskell | 273/126 R |
| 662,948 | 12/1900 | Lawrence et al. | 273/126 R |
| 1,610,620 | 12/1926 | Searle | 273/9 |
| 2,530,896 | 11/1950 | Metz | 273/126 A X |
| 3,088,735 | 5/1963 | Clark | 273/30 |
| 3,201,126 | 8/1965 | Nissen | 273/382 X |
| 3,398,957 | 8/1968 | King | 273/381 |
| 3,709,489 | 7/1971 | Holleran | 273/1 B |
| 3,782,726 | 1/1974 | Hoffman et al. | 273/85 F X |
| 3,955,815 | 2/1975 | Deschesnes | 273/1 B |
| 4,480,833 | 11/1984 | Barcelow et al. | 273/126 A X |
| 4,607,842 | 8/1986 | Daoust | 273/1 B |
| 4,765,622 | 8/1988 | Rienzo | 273/85 R |
| 5,249,797 | 10/1993 | Dowhy | 273/57.2 |

FOREIGN PATENT DOCUMENTS

| | | | |
|---|---|---|---|
| 81174 | 6/1983 | European Pat. Off. | 273/29 A |
| 286566 | 6/1931 | Italy | 273/9 |
| 1565940 | 4/1980 | United Kingdom | 273/126 R |

*Primary Examiner*—Paul E. Shapiro

[57] ABSTRACT

A reflex hockey/roller ball and street ball practice board which is compact and economical to build that tones the skills of a player at all levels of expertise from beginners to professionals. The board has a sensor which indicates by lights and/or a counter when the puck crosses the center line and encourages the player to increase their stick handling abilities. Also, goals are indicated by audio/visual means such as a bell or flashing lights. The wall structure includes a rebound material such as foam rubber and at least one wall includes an irregular surface for rebound un-predictability.

16 Claims, 4 Drawing Sheets 3
3
15
16
38
26
24
16
30
GOAL
41
12

34
5723
22
10
20
18
20
28
GOAL
41
32
30

COMBINATION HOCKEY AND ROLLER BALL REFLEX PRACTISE BOARD

FIELD OF THE INVENTION

This invention relates to the field of hockey and more particularly to a practise apparatus such as a reflex practise board to enhance the skills involved with ice, off-ice and other activities such as roller ball, and/or street hockey.

BACKGROUND OF THE INVENTION

In the past, it has been recognized that there exists a need for an apparatus or device to facilitate the very real needs of a hockey player to enhance the players skills in the art of stick handling and to improve his reflexes when striking or slapping a hockey puck or roller ball especially on its re-bound and/or when executing and controlling a slap-shot or wrist shot, etc.

An attempt to provide a practise apparatus is exemplified by U.S. Pat. No. 4,607,842 issued to Daoust of Canada comprising a long lane much like a bowling lane and uses an endless belt in conjunction with a puck dispenser, however, this apparatus takes up a large area and is not designed for reflex action but more particularly addresses goal shooting and is complicated.

Also, the U.S. Pat. No. 3,955,815 issued to Deschesnes of Canada teaches a training apparatus which, while being more compact, addresses the striking of the puck from one side only and its object is not to increase reflex but is designed to increase the strength of the player. The puck is returned after each stroke to the same location and the puck is struck from the same angle each time.

It is obvious, therefore, that a need exists for a compact, simple, portable reflex practise board which may be utilized by any player, weather the player is a beginner, or a professional and which may be utilized at home or the office or any convenient place to enhance his skills as a hockey player.

SUMMARY OF THE INVENTION

It is a primary object of the present invention to provide a compact, simple and economically feasible reflex practise board.

It is another object to provide a practise board which allows the player to practise their "sticking" by striking the puck alternately on each side of the puck.

Still another object is to provide a practise board with a center line, which when crossed over by the puck, will register and count the number of times the puck has crossed the line in relation to a time limit.

Yet another object is to provide a "goal" zone which when struck by the puck will indicate by suitable means such as a bell and/or lights that a goal has been made.

Another very important object is to provide resilient or rebound means such as foam rubber, spring members, air cushions, elastic strip, etc., around the periphery of the board to return the puck or ball at approximately the same speed which it attains after being struck.

Still another object is to provide at least one surface which is irregular to return the puck or ball in an undetermined direction.

Yet another object is to form the resilient means in a configuration or design which allows the puck and/or ball to strike the resilient means above it's center line to discourage "jumping" of the puck and/or ball.

It is another object to provide a puck with a magnetic portion which activates a magnetic device such as a reed switch when the puck crosses over or comes in close proximity to the devise.

It is another object to provide a puck which contains powder which is released during use.

Still another object is to cover the resilient means with a surface area or compartment which may contain lights, wiring harness and a see-thru strip.

It is another object to provide appropriate indica on the practise board in various locations to indicate goal areas, insignias, sponsors, etc.

Other objects and advantages will become apparent when taken into consideration with the following specifications and drawings.

DETAILED DESCRIPTION OF THE DRAWINGS

Figure 1:
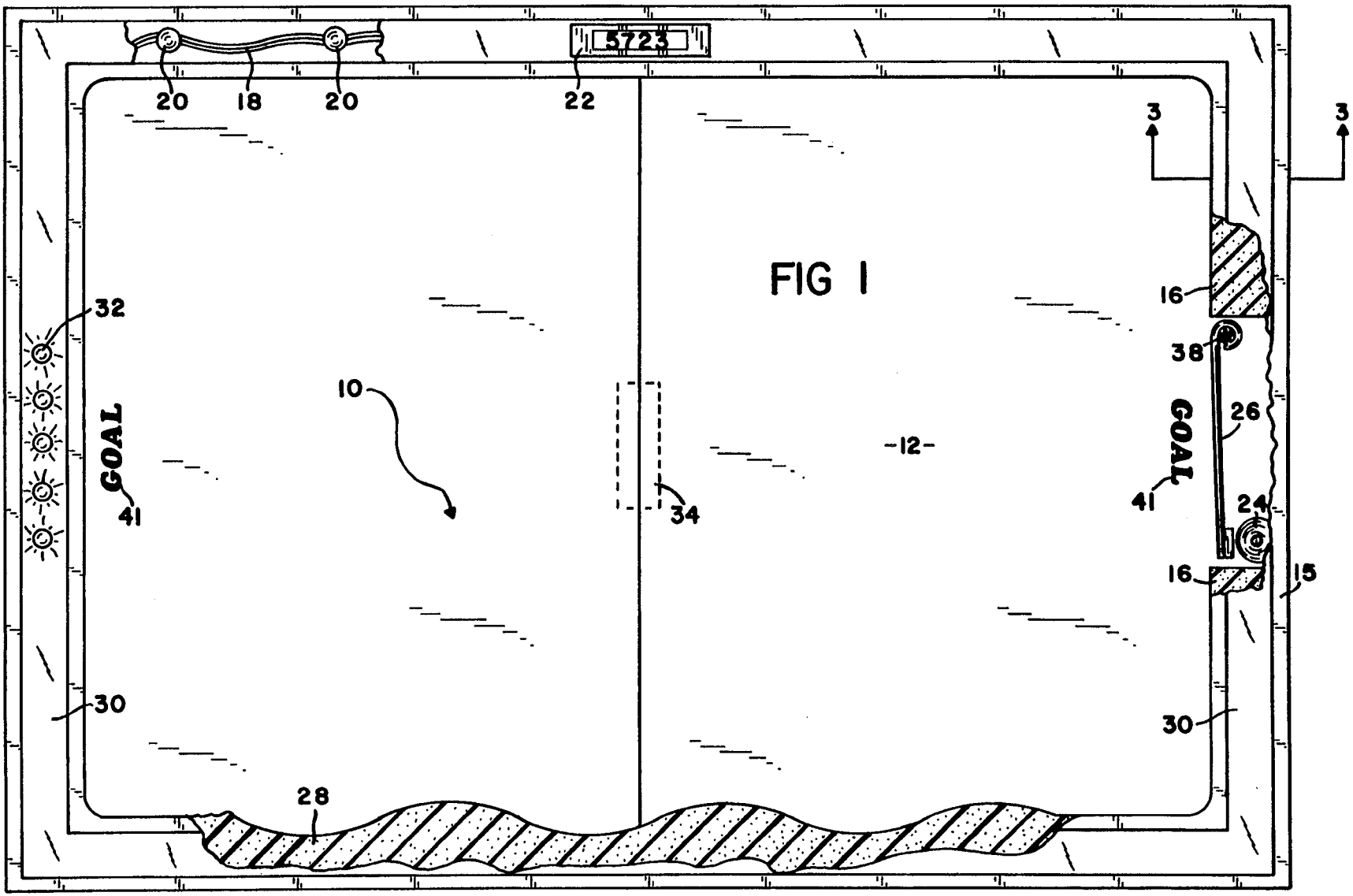
FIG. 1, is a plan view of the present invention with cut-a-way portions.
Figure 3:
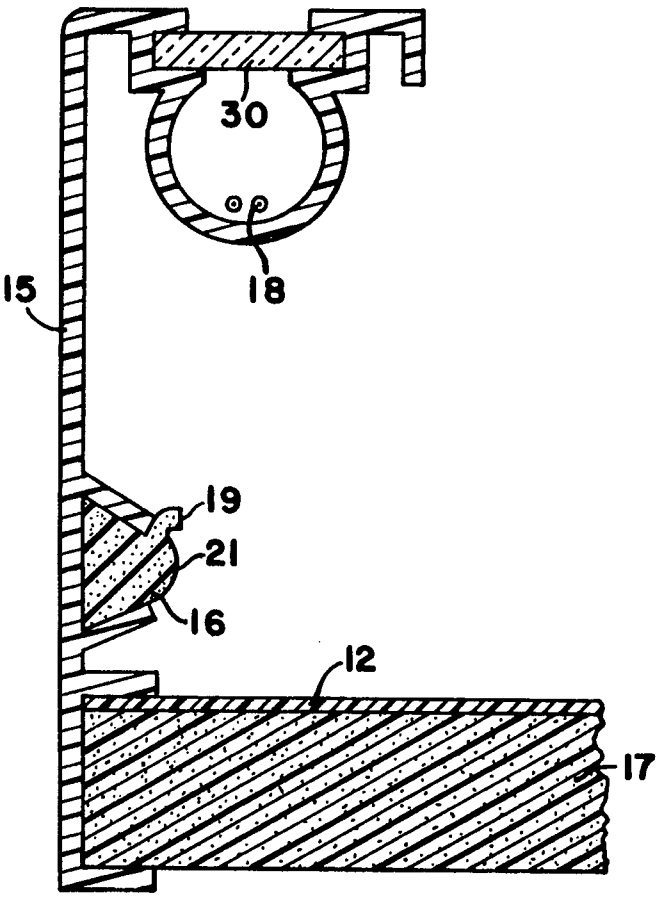
FIG. 3, is a section taken at 3—3 of FIG. 1.
Figure 2:
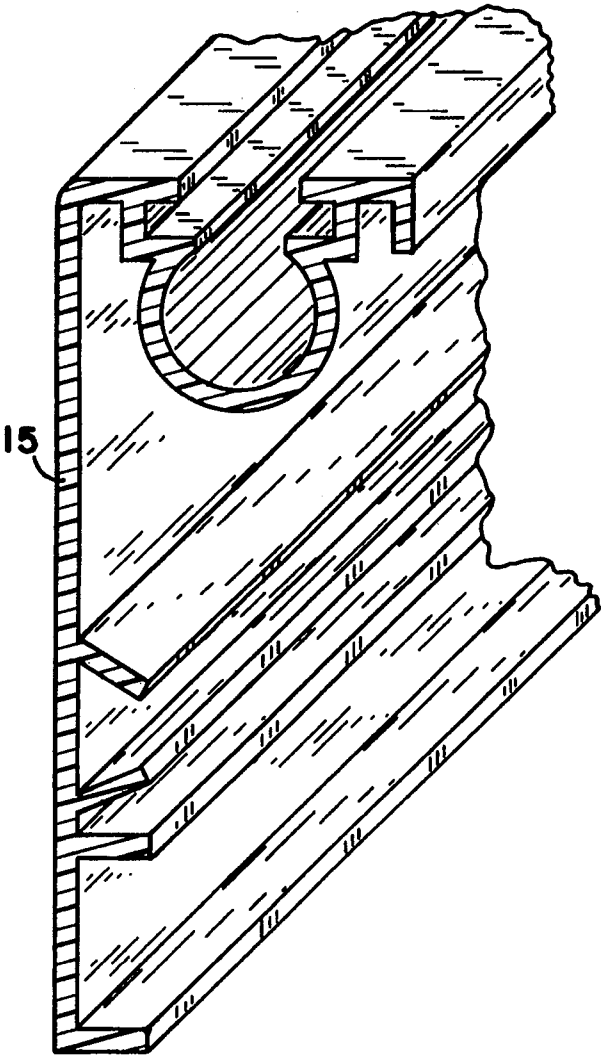
FIG. 2, is a perspective view of a section of the wall structure surrounding the playing surface.

Referring now to the drawings wherein like characters refer to like elements throughout the various drawings, 10 is an over view and plan view of the present invention having a playing surface 12 which may be made of plastic, wood or any other suitable material and is supported by a panel 17 (as shown in FIG. 3) is made of a material such as STYROFOAM which is substantially in the form of a rectangle such as is usual in a full size hockey rink, while the periphery of the playing surface 12 is surrounded by a suitable wall structure 15 which may be made of extruded plastic or other suitable material to form a housing for a resilient material such as foam rubber 16, wiring harness 18, lights 20, counting apparatus 22, bell 24, striker 26, irregular surface 28, see-thru strip 30 and goal lights 32.

Figure 5:
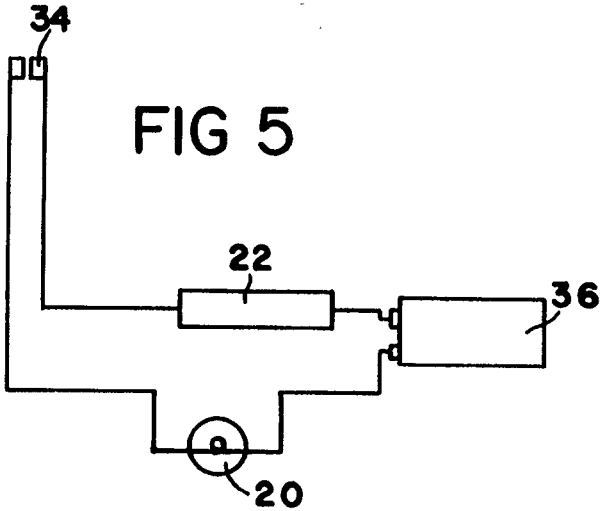
FIG. 5, is a schematic of a reed switch, battery, lights and counter in a circuit.

In the preferred embodiment, 34 is a magnetically operated switch such as a reed switch which is embedded in the playing surface 12 and which is in a circuit as shown in FIG. 5 in conjunction with a power source such as a battery 36, lights 20 and counter 22.

Figure 4:
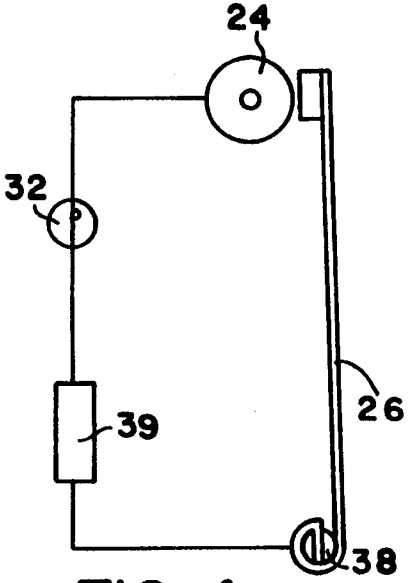
FIG. 4, is a schematic of a flasher light circuit associated with a bell.
Figure 10:
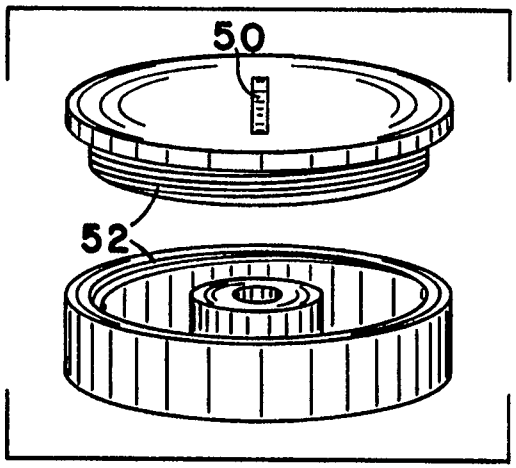
FIG. 10, is a perspective view of the second embodiment of the puck of FIGS. 8 and 9.

In FIG. 4, the striker 26 is made of a metal having a memory such as spring steel and supported by mounting stud 38 which is included in the circuit along with lights 32 and battery 39 and acts as a switch when the striker 26 comes in contact with bell 24.

Figure 7:
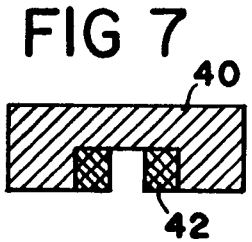
FIG. 7, is a section taken at 7—7 of FIG. 6.
Figure 6:
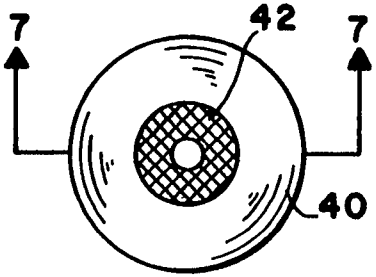
FIG. 6, is a bottom view of a puck having a magnetic insert.

FIGS. 6 and 7, respectively, disclose a hockey puck 40 which may be used in association with the practise board 10 and which contains a magnetic core 42 buried in its interior.

Figure 8:
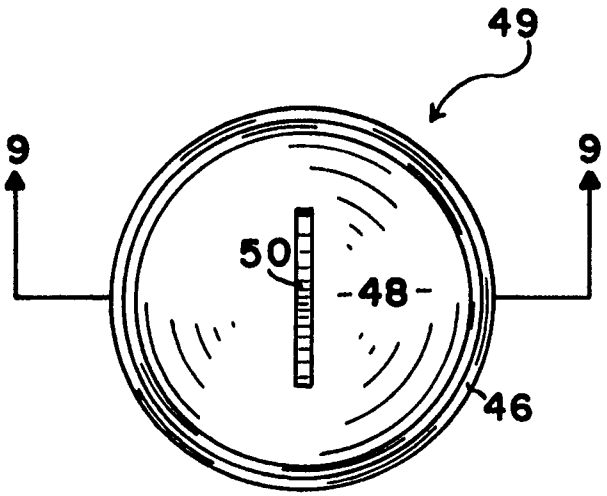
FIG. 8, is a top view of a second embodiment of a puck.
Figure 9:
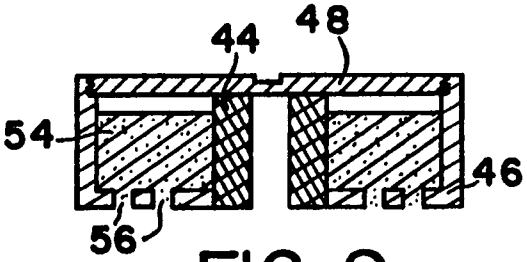
FIG. 9, is a section taken at 9—9 of FIG. 8.

FIGS. 8, 9 and 11 respectfully, disclose a second embodiment of a puck 49 with a magnetic core 44, casing 46, lid or cover 48, screwdriver slot 50, threads 52, which is filled with a powder 54. Powder 54 is dispensed with each hit from the hockey stick to the playing surface 12, which allows puck 49 to slide more easily on playing surface 12.

Foam rubber 16 is formed with a protrusion 19 which is designed to be above the center line of a typical roller ball (not shown) while the hockey puck 40 strikes the foam rubber 16 underneath protrusion 19 at section 21.

In the preferred embodiment, the STYROFOAM rectangular support panel 17 may have hollow areas to house wiring, reed switches, batteries, (not shown) etc., which allows flexibility of engineering choice when designing the lay out of the practise board 10.

Also, indicia such as goals 41 may be used by engineering choice for player instruction and art design.

It will now be seen that we have provided a hockey reflex practise board which is compact in size and yet highly efficient in toneing up the skills of a hockey player at all levels of performance and which may be made economically of standard materials and which may be used in conjunction with a regular hockey puck, roller ball, or in the preferred embodiment, with the disclosed hockey puck having a magnetic core as depicted in FIGS. 6 and 7, respectively.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A combination reflex practise board for use by hockey and roller ball players comprising; a playing surface, a wall structure having rebound means, said wall structure surrounding said playing surface, a hockey puck, a roller ball, said wall structure having a first and second substantially horizontal protrusion, said first protrusion being above a first plane passing thru the center of said puck, said first plane being parallel to said playing surface, said second protrusion being substantially above a second plane passing thru the center of said roller ball, said second plane being parallel to said playing surface, whereby;

when said hockey puck or said roller ball is propelled in a first direction against said wall structure having rebound means at a first velocity, said rebound means propels said hockey puck or said roller ball in a second direction at a second velocity, said second velocity being substantially equal to said first velocity.

2. The reflex practise board of claim 1 in which said playing surface is substantially rectangular.

3. The reflex practise board of claim 1 in which said rebound means includes at least one irregular linear section.

4. The reflex practise board of claim 1 in which said rebound means is foam rubber.

5. The reflex practise board of claim 1 including at least one goal area.

6. The reflex practise board of claim 5 in which said goal area has means to indicate that a goal has been made.

7. The reflex practise board of claim 6 in which said means to indicate that a goal has been made is visual.

8. The reflex practise board of claim 7 in which said visual means to indicate a goal includes an electrical circuit, said circuit including at least one light, a power source and means to activate said circuit.

9. The reflex practise board of claim 6 in which said means to indicate that a goal has been made is audio.

10. The reflex practise board of claim 9 in which said audio means to indicate that a goal has been made is by a bell.

11. The reflex practise board of claim 1 in which said wall structure includes a channel, a wiring harness, said wiring harness being in combination with a circuit including multiple lights, a power source and means to activate said circuit and said wiring harness being captured by said channel.

12. The reflex practise board of claim 1 in which said wall structure includes at least a section made of a clear see-thru material.

13. The reflex practise board of claim 1 in which said playing surface contains at least one section having sensor means to sense the passing of said hockey puck.

14. The reflex practise board of claim 13 in which said hockey puck contains at least one magnet, said magnet cooperating with said sensor means to activate said sensor means.

15. The reflex practise board of claim 13 in which said sensor means is a magnetically activated reed switch.

16. The reflex practise board of claim 13 in which said sensor means activates a counting apparatus.

* * * * *